US005816000A

United States Patent [19]

Izatt et al.

[11] Patent Number: 5,816,000

[45] Date of Patent: Oct. 6, 1998

[54] PARTITION SYSTEM

[75] Inventors: Alan Douglas Izatt, Kelty; Walter McCusker, Rosyth; Alexander Harper; Ronald James Weldon, both of Aberdour, all of Scotland

[73] Assignee: Havelock Europa Plc, Nottingham, England

[21] Appl. No.: 744,690

[22] Filed: Nov. 7, 1996

Related U.S. Application Data

[63] Continuation of Ser. No. 436,436, Dec. 20, 1995.

[30] Foreign Application Priority Data

Nov. 24, 1992 [GB] United Kingdom ..... 9224398
Jul. 21, 1993 [GB] United Kingdom ..... 9315139

[51] Int. Cl.[6] ..... E04C 3/30; E04H 17/00

[52] U.S. Cl. ..... 52/238.1; 52/239; 52/243; 52/481.1; 160/135

[58] Field of Search ..... 52/238.1, 243, 52/239, 474, 481.1; 160/135

[56] References Cited

U.S. PATENT DOCUMENTS

| | | |
|---|---|---|
| 3,374,593 | 3/1968 | Rensch . |
| 3,782,048 | 1/1974 | Corman . |
| 3,841,042 | 10/1974 | Siegal . |
| 3,879,017 | 4/1975 | Maxcy et al. . |
| 3,925,939 | 12/1975 | Costruba . |
| 4,388,786 | 6/1983 | Gassler . |
| 4,805,365 | 2/1989 | Bastian . |

FOREIGN PATENT DOCUMENTS

| | | |
|---|---|---|
| 7470044 | 6/1974 | Australia . |
| 7004474 | 8/1975 | Australia . |
| 0118411 | 9/1984 | European Pat. Off. . |
| 0118411 | 2/1985 | European Pat. Off. . |
| 0144030 | 6/1985 | European Pat. Off. . |
| 0144030 | 6/1987 | European Pat. Off. . |
| 0333686 | 9/1989 | European Pat. Off. . |
| 0522854 | 1/1993 | European Pat. Off. . |
| 8702879 | 2/1987 | France . |
| 8708527 | 6/1987 | France . |
| 2611856 | 9/1988 | France . |
| 2616822 | 12/1988 | France . |
| 2845017 | 4/1980 | Germany . |
| 8714853 | 4/1988 | Germany . |
| 795714 | 5/1958 | United Kingdom . |
| 844744 | 8/1960 | United Kingdom . |
| 1478589 | 7/1977 | United Kingdom . |
| 1497068 | 1/1978 | United Kingdom . |
| 1503588 | 3/1978 | United Kingdom . |
| 2060118 | 1/1980 | United Kingdom . |
| 2060118 | 4/1981 | United Kingdom . |
| 2107754 | 9/1982 | United Kingdom . |
| 2107754 | 5/1983 | United Kingdom . |
| 2278861 | 12/1994 | United Kingdom . |

*Primary Examiner*—Carl D. Friedman
*Assistant Examiner*—Timothy B. Kang
*Attorney, Agent, or Firm*—Young & Basile, P.C.

[57] ABSTRACT

The present invention relates to a structural support post (1) for use in a partition system (2) for supporting one or more panels (6) having panel support brackets (25) with hooks (44) at or in the vicinity of edges of the panel. The post (1) comprises a profile tube having a diameter of at least 70 mm and a multiplicity of angularly spaced longitudinal undercut slots (13), the walls of the slots being provided with insert plates (24) formed and arranged for engagement by hooks (44) provided on the panel support brackets (25). The support posts (1) may provide, in use, a substantially secure support for a security partitioning system (2).

24 Claims, 4 Drawing Sheets

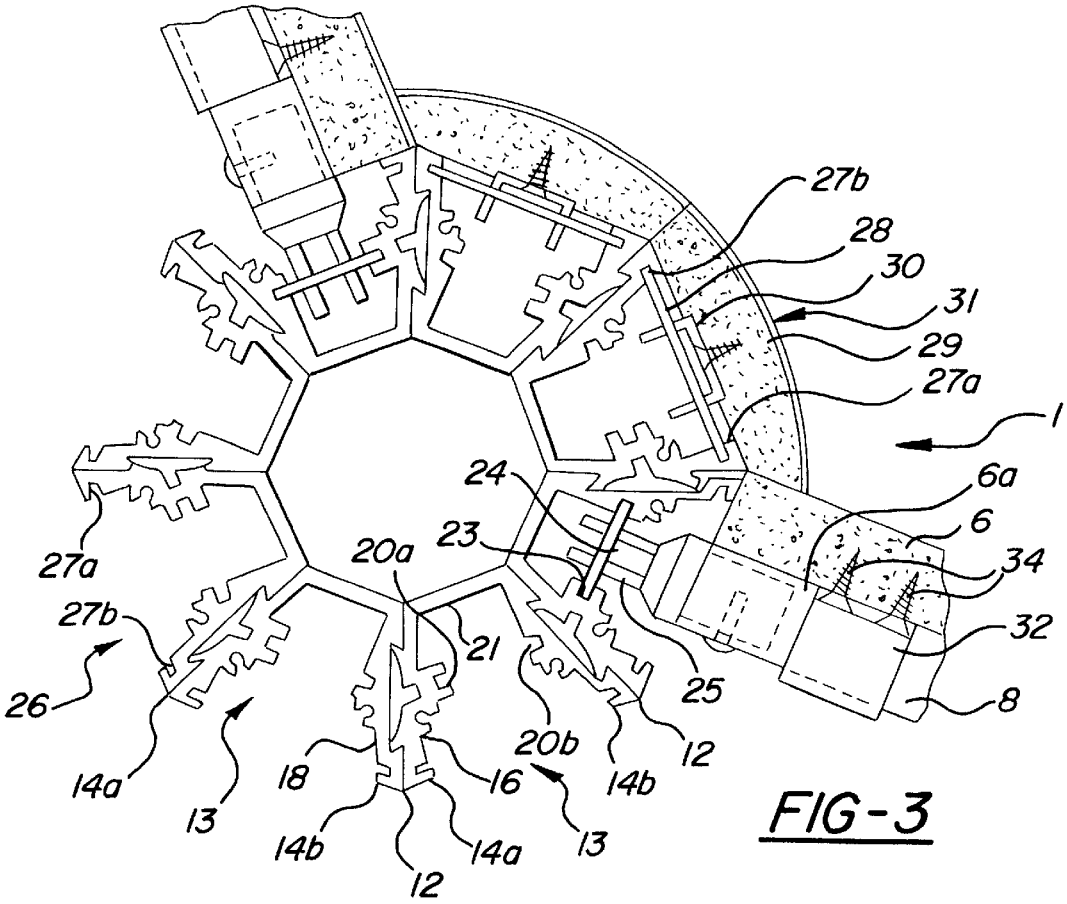
FIG-3
FIG-4
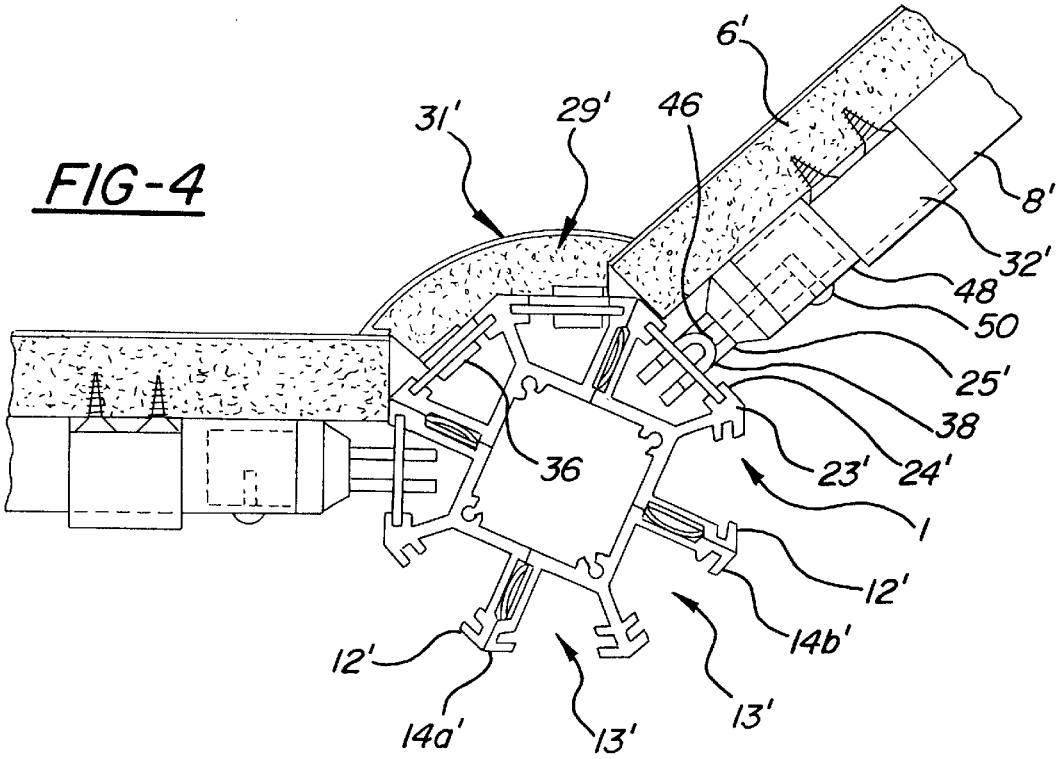

PARTITION SYSTEM

RELATED APPLICATION

This application is a continuarion of U.S. Ser. No. 08/436,436 filed Dec. 20, 1995 which is a U.S. National Application of PCT/GB93/02404 claiming priority of GB9224398.9, filed Nov. 24, 1992, and GB9315139.7, filed Jul. 21, 1993.

The present invention relates to a support post system suitable for use in supporting wall or partition panels and the like.

In various modern business buildings there is often a need for a flexible layout of walls or partitions for individual accommodation units such as customer service bays or in housing interactive-customer-technology machines, especially in a highly automated bank or other financial institution. These walls or partitions are generally constructed by traditional "on site" methods, produce a more or less permanent structure and are subject to substantial limitations in terms of finish, quality and flexibility. These walls or partitions need to be reasonably strong or substantial for security purposes which in turn generally implies a more or less permanent structure in conventional systems which cannot readily be modified.

It is an object of the present invention to avoid or minimize one or more of the above problems or disadvantages of previously known systems.

The present invention provides a structural support post for use in a partition system for supporting one or more panels having panel support means with first, releasable, engagement means at or in the vicinity of the panel edges of said panel(s), said post comprising a profiled tube having a diameter of at least 70 mm and a multiplicity of angularly spaced apart longitudinal undercut slots, the walls of said slots being provided with second engagement means formed and arranged for engagement by said first releasable engagement means provided on said panel support means, whereby said support post may provide, in use, a substantially secure support for a security partitioning system.

Preferably said slot walls are provided with opposed male and/or female portions formed and arranged for defining opposed channel means for slidably supporting therein, in use of the post, opposite edges of slotted strip means or the like suitable for engagement by said first releasable engagement means of the panel support means.

Although the support post is most conveniently made as a single extrusion, it may also be manufactured in a composite form made up of a plurality of separately formed interengaging sectoral elements. This may be preferred in some cases due to the relatively large size of the support post and hence of the extrusion constituting it.

Thus in a further aspect the present invention provides a structual support post for use in supporting one or more panels having panel support means with a predetermined configuration at or in the vicinity of the panel edges of said panel(s), said post comprising a plurality of interengaging sectoral elements each having first and second edge portions, each edge portion being interengaged with a respective edge portion of an adjoining sectoral element, said edge portions being provided with male and female engagement portions formed and arranged for captive interengagement of said edge portions, said sectoral elements being further provided at radially outward sides with male and/or female portions formed and arranged for generally complementary engagement, in use of the post, with a said panel support means for supporting a said panel, whereby said post may be used for engagement with the panel support means for supporting one or more panels.

Advantageously, the slot walls are each provided with a plurality of rib or fin means defining a plurality of narrow channels at different predetermined depths in the slot for supporting slotted strip means or the like and/or for engagement with deflectable clip means provided at the rear-side of elongate trim means formed and arranged for sealing off the slot means. Preferably at least one of said rib or fin means on each slot wall has an inwardly turned or cranked lip portion for providing a more positive interlocking with such clip means. Conveniently said rib or fin means are formed and arranged so as to define at least one outwardly facing shoulder at each slot wall for inter-abutment with shoulder means provided on trim means or the like, for lateral location thereof on the post. The combination of such location means with deflectable clip means on the rear-side of trim means is particularly advantageous from the point of view of facilitating accurate mounting of trim means on the post with the aid of clip means formed and/or arranged on the trim means to lower manufacturing tolerances.

Preferably the panel support means comprise elongate panel support members provided at respective ends with releasable engagement means formed and arranged for releasable engagement with slotted strip means or the like. Desirably the releasable engagement means comprise separately formed units, releasably connected to the elongate panel support members. Most preferably the elongate panel support members are formed and arranged so as to be disconnectable from the releasable (post) engagement means in situ i.e. while the latter are secured to posts of the invention, thereby to facilitate erection and dismantling of partition walls without the need for demounting of said posts. This is particularly advantageous where it is required partially to rearrange or modify an existing partition system of the invention. Conveniently the elongate panel support members are in the form of tubular members having side openings formed and arranged for entry/exit of the releasable (post) engagement means by lateral displacement of said members, most preferably by substantially vertical displacement of said members.

In general the partition panels are provided with securing means, hook means or the like at their rear sides, for securing to the elongate panel support members e.g. by hanging therefrom, without the need for structurally supporting the posts (by said panels). In this way the flexibility and ease of erection/dismantling, of the partitioning system, are further enhanced, as well as improving its appearance by substantially concealing the elongate support members.

It will be understood that a wide variety of slotted strip means or the like may be used with the posts of the invention, which may be mounted at different depths in the slots as required. Various suitable examples are well known in the art.

Advantageously the hollow interior of the profiled tube is provided with generally radially inwardly projecting rib means providing sliding engagement with an elongate tubular extension member telescopically engagable with said hollow interior for extension of the post at levels where the slots of the profiled post are not required.

In general said multiplicity of slots in the posts of the invention comprises at least 3 slots, preferably from 4 to 10 slots, e.g. 5, 6 or 8 slots. Conveniently the slots are regularly spaced, preferably equi-angularly distributed or spaced apart. In the case of an 8 slot post each sector containing a slot will have an included angle of 45°. In the case of the composite posts a corresponding number of sectoral elements is normally used.

The posts are conveniently in the form of extrusions of e.g. aluminium, steel, plastic composite or suitably strong alloy.

In the case of the composite support post, each sectoral element conveniently has the same form with a first, female, edge portion and a second, male, edge portion thereby simplifying stock control of the elements and assembly of the posts. It is though also possible to use different sectoral elements within a post with for example "male" elements wherein both first and second edge portions have male portions and "female" elements wherein both edge portions have female portions so that the post assembly has alternate "male" and "female" elements.

Conveniently the post is of generally annular form. The elements are conveniently of channel form with the opposite outer side faces constituting the first and second edge portions, and the inside faces being provided with male and/or female portions for engagement with the panel edges. Preferably the inside faces of the channel form elements are also provided with male and/or female formations in proximity to the distal edges of the channels defined by said elements, for supporting blanking plates for providing a generally planar outer surface on said post at those elements not supporting panel edges.

Advantageously the male and female portions on said element edge portions are of generally re-entrant form e.g. dove-tail form, so that adjacent elements may be joined together by parallel sliding together of the elements so as to insert the male portion into the female portion, thereby captively interengaging the elements at their adjacent edge portions.

The second engagement means provided at the walls of the longitudinal post slots (e.g. male and/or female portions) may be formed and arranged for directly engaging and supporting panels at the edges thereof which are formed and arranged so as to constitute releasable engagement means of the panel support means. More conveniently though (as note above) there is used a discrete releasable engagement means which is secured to the panels in any convenient manner. Preferably where said panel support means is formed and arranged for direct engagement, the panel support means comprises a support bracket having a hook or tongue form fixedly attached, directly or indirectly to a said panel in the vicinity of its side edge, said support bracket being formed and arranged to interengage in female portions in the form of slots or apertures provided directly in said post slots. Alternatively the slots or apertures may be provided in an insert plate e.g. slotted strip which is itself supported in two opposed channels within the post slots. Also there could be used support brackets fixed to respective ends of elongate support struts or members from which the panels are hung. Thus advantageously said panel support means includes a plurality of transverse, usually horizontal, support struts or members having a said support bracket at each end thereof for engagement directly with a post or indirectly via a said insert plate mounted in a said post. The support panels may be hung from the support struts in any suitable manner, e.g. using suitable hooks or releasable fasteners provided on said panels for engagement with the support struts.

Desirably, the support brackets used are provided with locking means for preventing unintentional or unauthorized disengagement from the posts or slotted strips or the like mounted thereon. One particularly suitable example of a locking bracket system is further described hereinbelow in the detailed description of preferred embodiments.

In a further aspect the present invention provides a wall assembly comprising a plurality of panels and a plurality of support posts of the invention, with each of said panels extending between a pair of said support posts. Advantageously said assembly further includes a plurality of transverse, usually horizontal, support struts.

The wall panels may, moreover, be furnished with architectural facilities such as doors or window openings (glazed or unglazed) office facilities such as shelving, and/or customer service facilities such as counters, automated teller machines (ATMs), etc. The panels can be, where required, of security grade construction, that is, they are of generally reinforced construction and/or have in-built security devices such as sensor means adapted for setting off local and/or remote alarms upon penetration of the fabric of the panel to a greater or lesser extent.

In yet another aspect the present invention provides a security partitioning system comprising a plurality of posts of the invention, and a plurality of said panels with panel support means.

It should be noted that the posts of the invention may be of at least two different grades or kinds with primary posts of a relatively substantial construction and provided with means for securely anchoring permanently or semi-permanently to the main fabric of the building e.g. to floors and structural ceiling elements, and secondary posts of a somewhat lighter construction which are supported in use from the primary posts via transverse struts and/or panels, and intended to be more or less readily moveable by means of undoing releasable fasteners, which are preferably formed and arranged so as to be more or less inaccessible to the public at least in the case of lighter security installations.

In yet another aspect the present invention provides a sectoral element for a structural support post assembly which element comprises an elongate sector-shaped section channel-form member having at each of its opposite outer sides female and/or male projection means for interengagement with male and/or female projection means respectively, of a similar sectoral element, whereby in use of said element, a plurality of similar elements may be assembled together to form a structural post and a panel edge disposed between said opposite sides of a said element for support of the panel by said post.

Further preferred features and advantages of the invention will appear from the following detailed description given by way of example of some preferred embodiments illustrated with reference to the accompanying drawings in which:

FIG. 3 is a plan view of the support post shown in FIG. 2;

FIG. 4 is a plan view of a second embodiment of composite support post;

Figure 1:
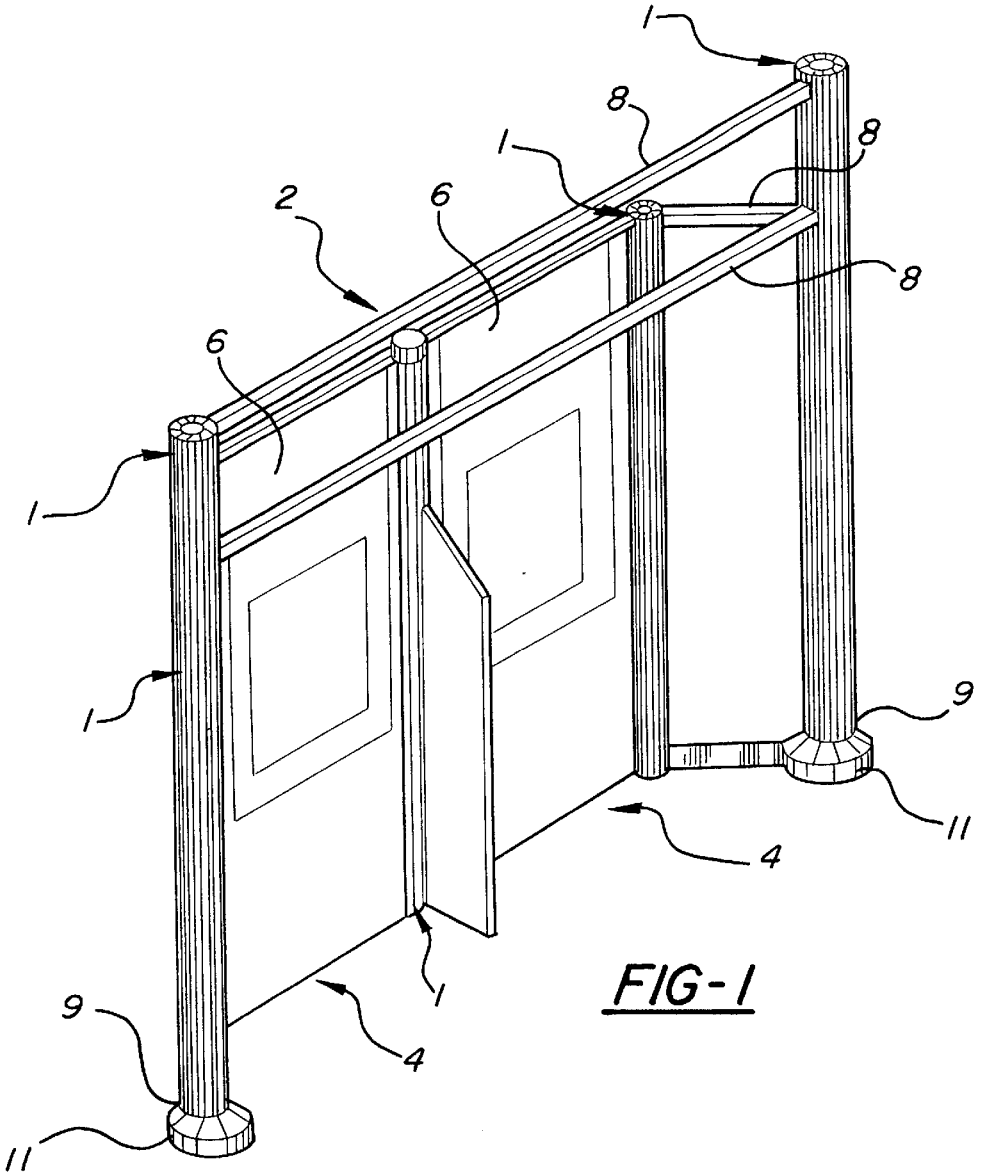
FIG. 1 is a perspective view of a walled partition including the structural support posts of the invention.

Reference is first made to FIG. 1 which shows five structural support posts, generally indicated by reference number 1, arranged and interconnected to each other to form a walled partition 2 for accommodating customer service bays 4. The support posts 1 are interconnected by panels 6 extending between a pair of support posts 1. Support struts 8 are provided to interconnect pairs of support posts 1 not directly interconnected by panels 6. The support posts 1 are fitted into sockets 9 in annular bases 11 so as to provide the posts 1 in an upright position and thereby also provide support to the walled partition 2.

Figure 2:
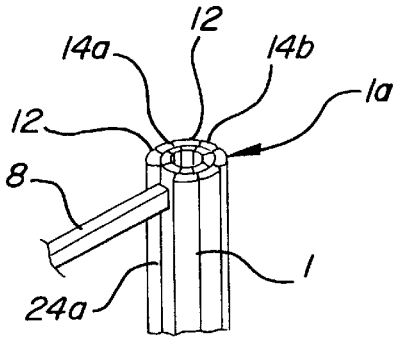
FIG. 2 is a perspective view of a first embodiment of a composite structural support post of the invention.

FIG. 2 shows in more detail the top portion 1*a* of the right hand support post 1 of FIG. 1 supporting a support strut 8 for interconnection with the left hand support post of FIG. 1. The support post 1 comprises a plurality of interengaging sectoral elements 12 each having first and second edge portions 14*a,b* each edge portion being interconnected with a respective edge portion of an adjoining sectoral element 12.

In more detail and with particular reference to FIG. 3, which shows a detailed plan view of the support post 1 in FIGS. 1 and 2, the support post 1 comprises eight interengaging sectoral elements 12 having first and second edge portions 14*a,b*. Each of the first and second edge portions 14*a,b* has male 16 and female 18 engagement portions, respectively, for captive interengagement of the edge portions 14*a,b* of adjoining sectoral elements 12. The elements 12 have a more or less channel like form section defining a channel 13 along their length with the opposite outer side faces constituting the first and second edge portions 14*a,b*. The inside faces of the channels 13 of the elements 12 are provided with a first pair of opposed grooves 20*a,b,* intermediate the base 21 of the channel 13 and its mouth 26, for engagement with the edges 23 of an insert plate 24. The insert plate 24 has a plurality of slots 24*a* (See FIG. 2) along its length for receiving hook-form brackets 25 connected to the ends 8*a* of the support struts 8. Adjacent the mouth 26 of the channel 13, the inside faces of the channels 13 of the elements 12 are further provided with a second pair of opposed grooves 27*a,b* in proximity to the edges of the channel 13 of the elements 12 for supporting support plates 28 having blanking plates 29 mounted via hook brackets 30 for providing a generally planar outer surface 31 on the post at those elements 12 not supporting panels 6.

The support panels 6 are hung onto the supports struts 8 and secured thereto by brackets 32 attached to the back side 6*a* of the panel 6 by screws 34.

FIG. 4 shows a second embodiment of post 1 generally similar to the embodiment in FIG. 3 and like parts corresponding to those in FIG. 3 embodiment are indicated by like reference numbers with a prime added.

Figure 5:
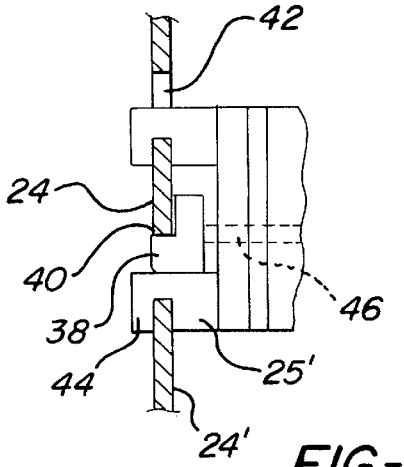
FIG. 5 is a detail side view of part of the panel support means of the embodiment of FIG. 4.

The support post $1^1$ comprises four interengaging sectoral elements $12^1$ having first and second edge portions $14^1a,b$. Each element $12^1$ has a sectional form defining two channels $13^1$ for each receiving and engaging with the edges $23^1$ of an insert plate $24^1$ for supporting via hook-form brackets $25^1$ a support strut $8^1$ for supporting a panel $6^1$. Blanking plates $29^1$ provide for a generally planar outer surface $28^1$ on the post $1^1$ where not in use for supporting a panel $6^1$. The blanking plates $29^1$ are also mounted onto the insert plates $24^1$ via simple hooks 36. In order to prevent unhooking of the hooked brackets $25^1$ from the insert plate $24^1$, (See FIG. 5) there is desirably provided a retractable wedging element in the form of a small "U"-shaped section channel member 38 which is driven into the upper parts 40 of the slots 42 in the insert plate $24^1$ above the lower of the hooks 44 of the panel support brackets $25^1$, once the hooks 44 are fully engaged, by means of a grub screw 46. When the panel support brackets $25^1$ are secured in place the ends 48 of the box-section support struts $8^1$ are lowered onto the brackets $25^1$ and secured thereto by screws 50.

It will be appreciated that various modifications may be made to the above described embodiments without departing from the scope of the present invention. Thus for example two or more support posts may be directly interengaged to each other to form an even more substantial support post.

In FIGS. 6 to 9 like parts corresponding generally to those in FIGS. 1 to 5 are indicated by like reference numerals.

Figure 6:
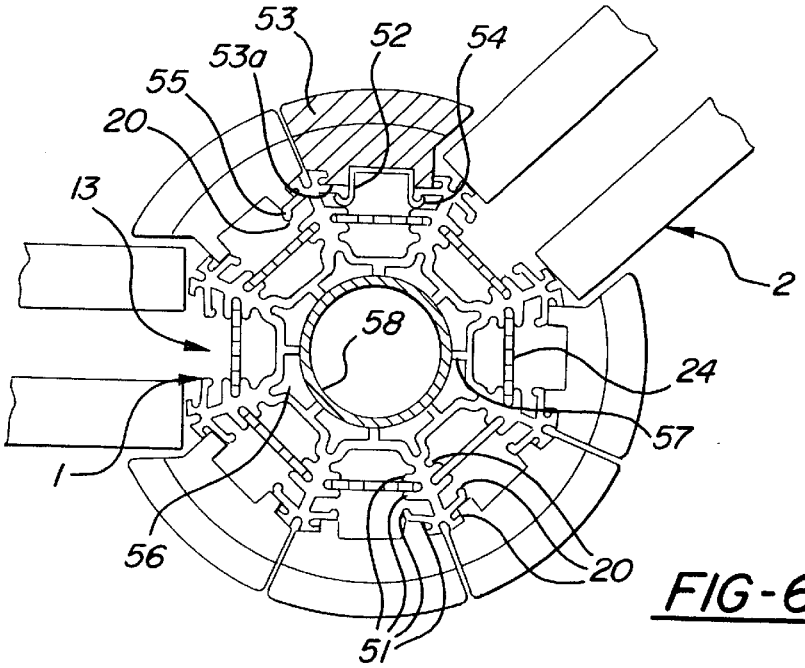
FIG. 6 is a plan view of a further embodiment in the form of an integrally formed post of the invention.

The structural support post 1 as shown in FIG. 6 is in the form of a one-piece integrally formed single extrusion defining a plurality of radially outwardly facing undercut slots or channels 13 each with a plurality of fins 51 defining several grooves or channels 20 for supporting a slotted insert plate of strip 24 or engaging retaining clip means 52 of a trim member 53. In more detail the clip means is in the form of short lengths of resiliently deformable plastics material channel section with outwardly turned lip portions 54 which inter-engage in snap-fit manner with inwardly turned lip portions 55 in outer channels $20^1$.

The fins 51 also define at least one outwardly facing shoulder at each slot 13 for inter-abutment with shoulder means 53*a* provided on the trim member 53, for lateral location thereof on the post 1.

In FIG. 6 the support post 1 shown is being used to support two double-sided partitions 2 via horizontally extending struts (not shown in this drawing—see FIGS. 7–9), extending at 135° to each other. The slots 13 not used to support partitions are closed off with trim members 53 as described above. The hollow interior 56 of the post 1 has a plurality of radially inwardly extending ribs 57 for facilitating telescopic sliding movement therein of cylindrical tubular extension member 58 (see also FIG. 9) which is used to secure the upper end 59 of the post 1 to a permanent ceiling or other structural member. The extension member is secured at the desired degree of extension via a collar 60 mounted at the upper end 59 of the post 1 and a grub screw 61.

The base of the post 1 is provided with adjustable foot means 63 for facilitating levelling, which are seated in cups 64 secured 65 to the permanent floor 66 or other structural member.

Figure 7:
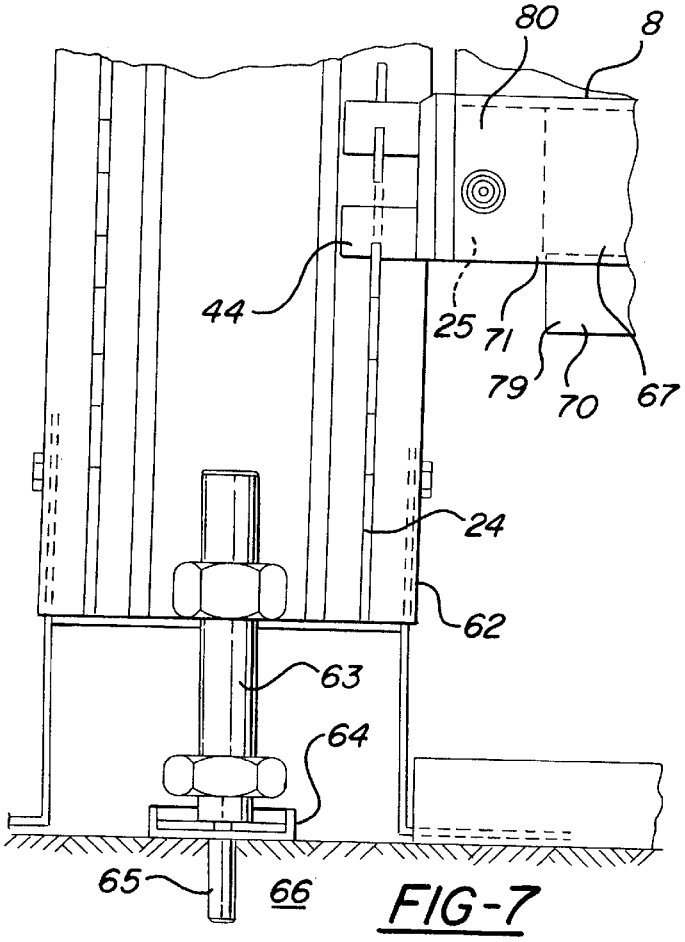
FIG. 7 is a transverse vertical section through a security partition of the invention.
Figure 8:
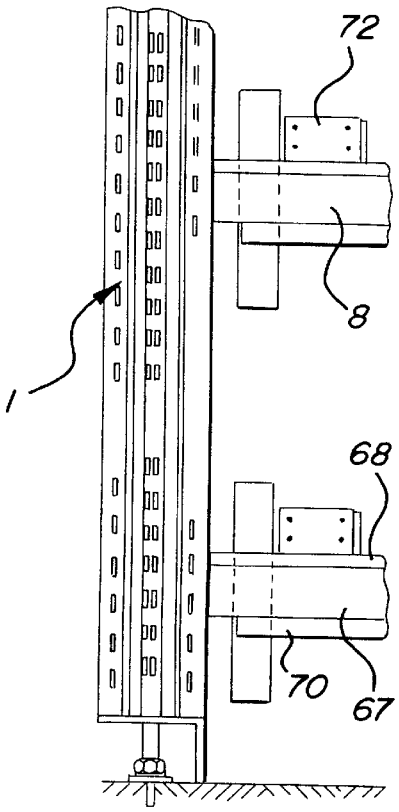
FIG. 8 is a rear view of the security partition of FIG. 7.
Figure 9:
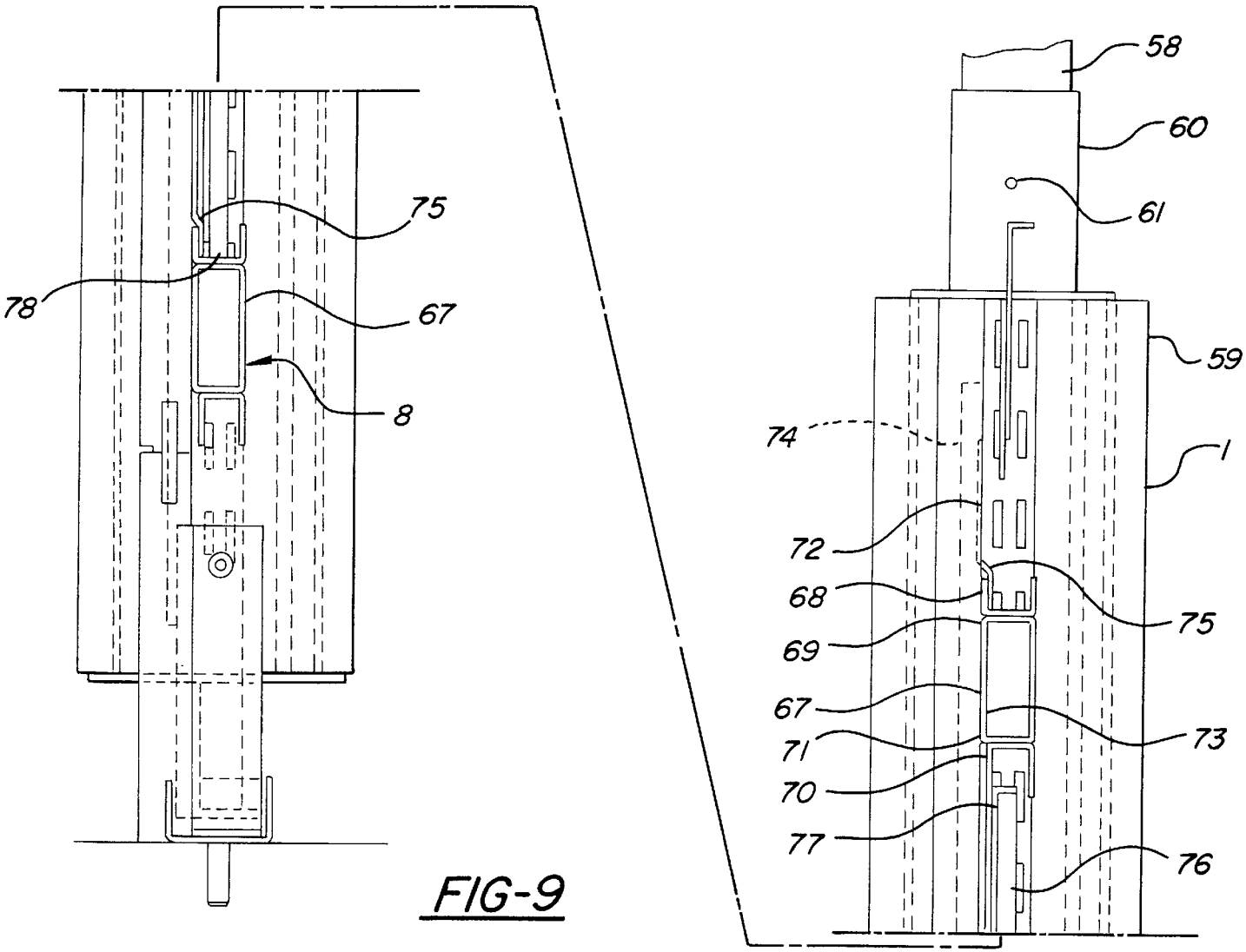
FIG. 9 is another vertical section in a plane orthogonal to that of FIG. 7.

As shown in FIGS. 7 to 9 the horizontally extending struts 8 are generally in the form of rectangular section tubular members 67 with a full width outwardly facing, upper, channel 68 secured to the upper edge 69 and a slightly narrower outwardly facing, lower, channel 68 at the lower edge 71. Hook plates 72 are secured to the rear face 73 of partition panels 74 with lower edge portions 75 offset from the partition panel rear face 73 for hooking over one side of the full width upper channel 68 thereby defining a narrower channel corresponding in width to the narrower lower channel 70. Steel security panels 76 are mounted with the upper and lower channels 68, 70 by first pushing an upper edge 77 up into a lower channel 70 then swinging a lower edge 78 in towards the rear face 73 of the partition 74 above an upper channel 68 and then allowing it to drop thereinto.

The ends 79 of the lower channels 70 are set back and the lower edge 71 of the main tubular members 67 of the struts 8 are cut away at their free ends 80 so that the struts 8 can be lowered onto the brackets 25 (as described above with reference to FIG. 5) once these have been secured to the slotted strip 24 in the support post 1. This considerably facilitates erection of the partition system and is especially useful when it is desired to modify a layout by changing the position and/or nature of certain partition panels without the need for demounting of the support post(s) themselves.

We claim:

1. A security walling partitioning system suitable for use inside a building to separate substantially a restricted access space having a floor and a ceiling from a pubic access space, from said floor to said ceiling, said partitioning system comprising a plurality of structural support posts supporting a plurality of security wall panels each having panel edges and each having support means with first, releasable, engagement means at or in the vicinity of the panel edges of said panel, each said post comprising a profiled tube having a diameter of at least 70 mm and a multiplicity of angularly spaced apart longitudinal undercut slots, said slots having walls formed and arranged for captively mounting a second engagement means comprising an elongate slotted strip means extending along the length of said longitudinal undercut slots and formed and arranged for releasable engagement by said first engagement means provided on said panel support means, said panel support means including locking means for substantially securing said first and second engagement means together against unauthorized disengagement, each said post having a said panel edge of at least one said panel secured thereto by means of a respective first and second engagement means.

2. A system as claimed in claim 1 wherein said structural support post (1) is in the form of a single extrusion.

3. A system as claimed in claim 1 wherein said structural support post (1) is of a composite form made up of a plurality of separately formed interengaging sectoral elements (12).

4. A system as claimed in claim 3 wherein said structural support post (1) is of generally annular form and the elements are of channel form (13) having opposite outer side faces constituting first and second edge portions, and having inside faces being provided with male and/or female portions for engagement with the panel edges.

5. A system as claimed in claim 4 wherein the inside faces of the elements of channel form are provided with male and/or female formations (51) in proximity to the outer edges of the channels (13) defined by said elements, for supporting blanking plates (31) for providing a generally planar outer surface on said post at those elements not supporting panel edges.

6. A system as claimed in claim 1 wherein the walls of said structural support post slots (13) are provided with opposed male and/or female portions (51, 20) formed and arranged for defining opposed channel means (20) for slidably supporting therein opposite edges of said slotted strip means or the like (24).

7. A system as claimed in claim 1 further including elongate trim means (53) formed and arranged for sealing off slots (13) not in engagement with panel edges, said elongate trim means being provided at a rear-side thereof with deflectable clip means (52), and wherein said walls of said structural support post slots (13) are each provided with a plurality of rib or fin means (51) defining a plurality of narrow channels (20) at different predetermined depths in the slot (13) for supporting said slotted strip means (24) at a predetermined depth and suitable for engagement, where required, with said deflectable clip means (52) provided at the rear side of said elongate trim means (53).

8. A system as claimed in claim 7 wherein at least one of said rib or fin means on each slot wall has an inwardly turned or cranked lip portion (51) for providing a more positive interlocking with such clip means (52).

9. A system as claimed in claim 7 wherein at least one of said rib or fin means are formed and arranged so as to define at least one outwardly facing shoulder (51) at each slot wall for inter-abutment with shoulder means provided on trim means (53), for lateral location thereof on the post (1).

10. A system as claimed in claim 1 wherein said panel support means comprise elongate panel support members (8) extending between opposite panel edges and provided at respective ends with said releasable engagement means (44) formed and arranged for releasable engagement with slotted strip means (24).

11. A system as claimed in claim 10 wherein said releasable engagement means comprise separately formed units ($25_1$), releasably connected to the elongate panel support members (8).

12. A system as claimed in claim 1 wherein said profiled tube (1) has a hollow interior (58) provided with generally radially inwardly projecting rib means (57) providing sliding engagement with an elongate tubular extension member (58) telescopically engagable with said hollow interior (56) for extension of the post at levels where the slots (13) of the profiled post (1) are not required.

13. A system as claimed in claim 1 wherein said structural support post (1) has at least 3 slots (13) equi-angularly distributed.

14. A system as claimed in claim 13 wherein said structural support post has from 4 to 10 slots (13).

15. A system claimed in claim 1 wherein said first engagement means comprises a support bracket having a hook or tongue form fixedly attached, directly or indirectly, to a said panel in the vicinity of a side edge thereof, said support bracket being formed and arranged to interengage in apertures provided in said elongate slotted strip means or the like so that said first engagement means is held locked against movement relative to said slotted strip means longitudinally of the post.

16. A system as claimed in claim 15 wherein said panel support means includes a plurality of generally horizontal, support struts or members (8) having a said support bracket (25) at each end.

17. A system according to claim 1 wherein a said security wall panel (6) comprises a double-sided partition.

18. A system according to claim 17 wherein said double-sided partition comprises spaced apart planar elements in a cavity wall form of construction.

19. A system according to claim 18 wherein one of said planar elements comprises a steel panel element.

20. A system according to claim 1 wherein said wall panels (6) are furnished with architectural facilities and/or office facilities.

21. A system according to claim 1 wherein said wall panels (6) are furnished with banking customer service facilities.

22. A system according to claim 21 wherein a said wall panel (6) is furnished with an automated teller machine.

23. A system as claimed in claim 1 wherein said structural support posts are provided with lower and upper anchorage means for securely anchoring said posts to the floor and to structural ceiling elements, whereby said support post provide a substantially secure support for said security partitioning system for preventing displacement of said partitioning system.

24. A system as claimed in claim 23, in combination with a building having a floor and structural ceiling elements, the system being installed in the building with said structural support posts securely anchored to the building floor and to the building structural celling elements.

* * * * *